United States Patent [19]

Cameron

[11] 3,943,935

[45] Mar. 16, 1976

[54] DISPOSABLE EARLOBE PIERCING APPARATUS

[76] Inventor: Robert C. Cameron, 301 Hilltop Drive, Chula Vista, Calif. 92010

[22] Filed: Sept. 7, 1973

[21] Appl. No.: 395,016

[52] U.S. Cl. ..... 128/330

[51] Int. Cl.[2] ..... A61B 17/00

[58] Field of Search ..... 128/329, 330; 63/12

[56] References Cited

UNITED STATES PATENTS

| | | | |
|---|---|---|---|
| 230,073 | 7/1880 | Seyfarth | 128/329 |
| 269,383 | 12/1882 | Caldwell | 63/12 X |
| 2,798,491 | 7/1957 | Samuels | 128/330 |
| 3,187,751 | 6/1965 | Coren et al. | 128/330 |

FOREIGN PATENTS OR APPLICATIONS

| | | | |
|---|---|---|---|
| 84,266 | 12/1895 | Germany | 128/329 |
| 2,597 | 1903 | United Kingdom | 128/330 |
| 1,175,910 | 11/1958 | France | 128/329 |

*Primary Examiner*—Channing L. Pace
*Attorney, Agent, or Firm*—Brown & Martin

[57] ABSTRACT

Apparatus for piercing the earlobe to produce an opening for the wearing of earrings. A relatively movable anvil and carriage are provided. The carriage mounts a precompressed spring, bearing against a piercing dart. A spring housing and barrel on the carriage are also relatively movable. The earlobe is placed between the anvil and carriage and the carriage moved into engagement with the earlobe. Further pressure on the carriage produces relative movement between the spring housing and barrel and this relative movement causes dual triggers to be cammed out of engagement with the piercing dart. The movement of the triggers releases the dart which pierces the earlobe and is guided into a catch button on the anvil. A catch spring engages the shaft of the piercing dart and holds the parts in association so that the body portion of the apparatus may be removed.

9 Claims, 5 Drawing Figures

DISPOSABLE EARLOBE PIERCING APPARATUS

BACKGROUND OF THE INVENTION

The piercing of earlobes for the wearing of earrings has become increasingly popular in recent years. Pierced earlobe earrings are considered to be more attractive in appearance than those of the earlobe grasping variety. The piercing of earlobes is a relatively simple process as conducted by a registered nurse or physician, but the employment of a professional medical person involves extra expense and is a deterrent to the sale of the pierced earrings and their use. Many individuals, to avoid the cost and inconvenience of seeking professional help, employ various home remedy approaches to the earlobe piercing problem. As a result, there are frequent instances of damage to the earlobe. While the earlobe is a relatively insensitive part of the body, it is nonetheless susceptible to infection, tearing and similar damage. Further, the nature of the materials allowed to contact the wound immediately after the earlobe is pierced is important. The use of improper materials or unsterilized materials can result in later problems.

Various devices have been proposed to accomplish the desired pierced opening through the earlobe. Such devices have included those wherein a spring is provided which spring is cocked by the user to a selected compression and then a piercing tip is projected through the earlobe against some cooperating portion of the device. These devices are susceptible to repeated usage and thus are susceptible to the production of infection. Further, since their piercing velocity and force is dependent upon the manner in which they are operated by the user, they are susceptible to irregular results. Finally, since no provision is made to retain a shaft through the pierced opening over a sufficient period to prevent closing of the wound, the devices frequently do not provide the desired result.

Therefore it is desirable to have an earlobe piercing apparatus which minimizes the hazards associated with an individual piercing her own ears and which minimizes the chance of infection or of an improper amount of force being utilized to propel the piercing element. Such a device is particularly desirable where it provides for a piercing shaft to be retained in the earlobe for a sufficient period to prevent improper healing or closing of the pierced opening.

SUMMARY OF THE INVENTION

An exemplary embodiment of the invention incorporates relatively movable carriage means and anvil means. The carriage means mounts a dart which is contacted by a spring under a preset compressive stress. The anvil portion of the device is mounted in opposition to the carriage and provides for the mounting of a catch button. The catch button includes a catch spring and a cover portion with a funnel shaped opening which guides the piercing dart into an opening in the catch spring wherein the piercing dart is retained on the earlobe by the catch button.

The carriage comprises two relatively movable portions including a spring housing and barrel portion. The barrel portion is sized to receive and pass the body portion of the dart and a guide bushing. The guide bushing is received on the shaft portion of the dart. The spring housing mounts a pair of opposed triggers. When the carriage portion is moved into contact with the earlobe, and additional pressure is applied, producing relative motion between the spring housing and barrel, the triggers are forced into engagement against the pressure of the spring with ramp portions of the barrel. These ramp portions cam the triggers out of locking engagement with the body portion of the dart, releasing the dart and permitting the energy retained in the precompressed spring to drive the dart through the earlobe and into the catch button as described. The triggers are made of a frangible material so that the camming action breaks the triggers obviating the possibility of the reuse of the device.

Thus there is provided an earlobe piercing apparatus which overcomes the difficulties associated with prior art earlobe piercing devices and provides an apparatus which is of sufficient simplicity that it may be made disposable, and may be rendered inoperative by a single operation to avoid the problems of infection associated with repeated usages, and further provides a device which permits an individual to pierce her earlobes without the necessity of professional help in that the piercing force is uniform and the device provides its own positioning and dart retaining functions.

It is therefore an object of the invention to provide a new and improved disposable earlobe piercing apparatus.

It is another object of the invention to provide a disposable earlobe piercing apparatus which is low in manufacturing cost.

It is another object of the invention to provide a new and improved disposable earlobe piercing apparatus which is easy to use by untrained individuals.

It is another object of the invention to provide a new and improved disposable earlobe piercing apparatus which is disabled after an initial use.

It is another object of the invention to provide a new and improved disposable earlobe piercing apparatus with regulated uniform earlobe piercing force.

It is another object of the invention to provide a new and improved disposable earlobe piercing apparatus with stored earlobe piercing energy.

It is another object of the invention to provide a new and improved disposable earlobe piercing apparatus which minimizes the danger of inadvertent operation and damage to body portions other than the earlobe.

It is another object of the invention to provide a new and improved disposable earlobe piercing apparatus that accurately guides the earlobe piercing shaft.

It is another object of the invention to provide a new and improved disposable earlobe piercing apparatus with automatic retention of the shaft within the pierced opening.

It is another object of the invention to provide a new and improved disposable earlobe piercing apparatus which presents an attractive appearance when installed in an individual's earlobe.

Other objects and many attendant advantages of the invention will become more apparent upon a reading of the following detailed description together with the drawings in which like reference numerals refer to like parts throughout and in which.

Figure 1:
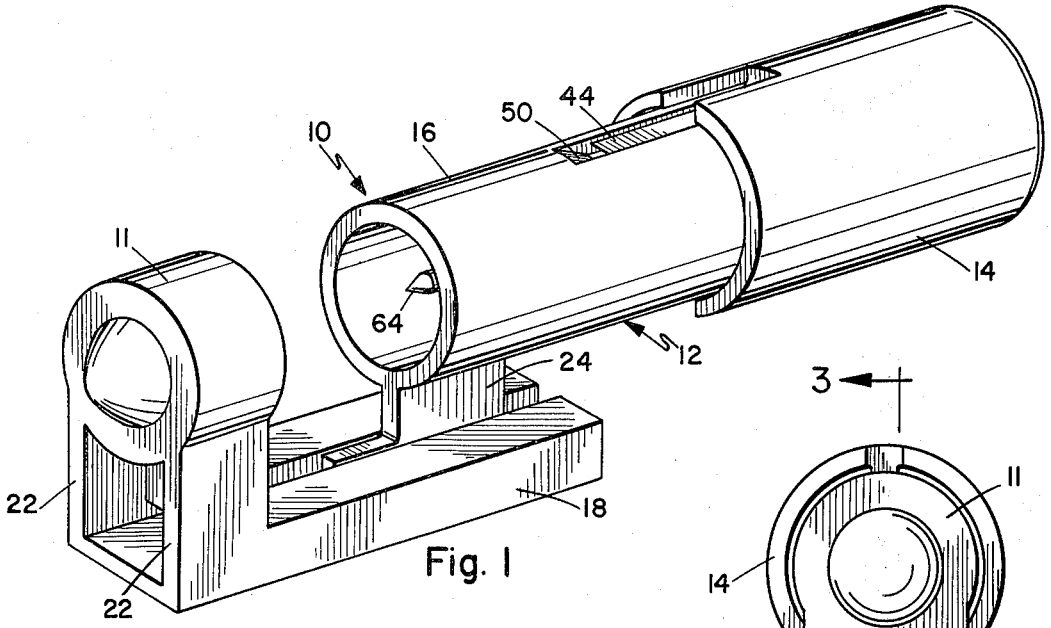
FIG. 1 is a perspective view of the complete earlobe piercing apparatus ready for use.
Figure 2:
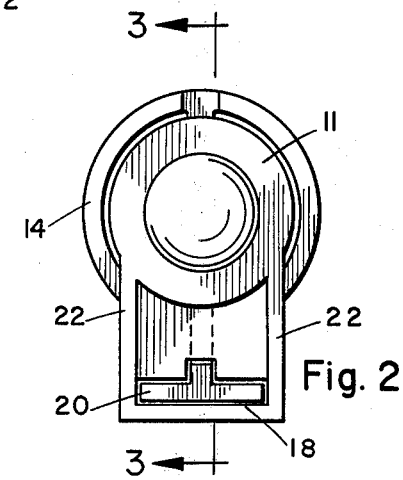
FIG. 2 is an end elevation view as taken from the left hand end of FIG. 1.
Figure 3:
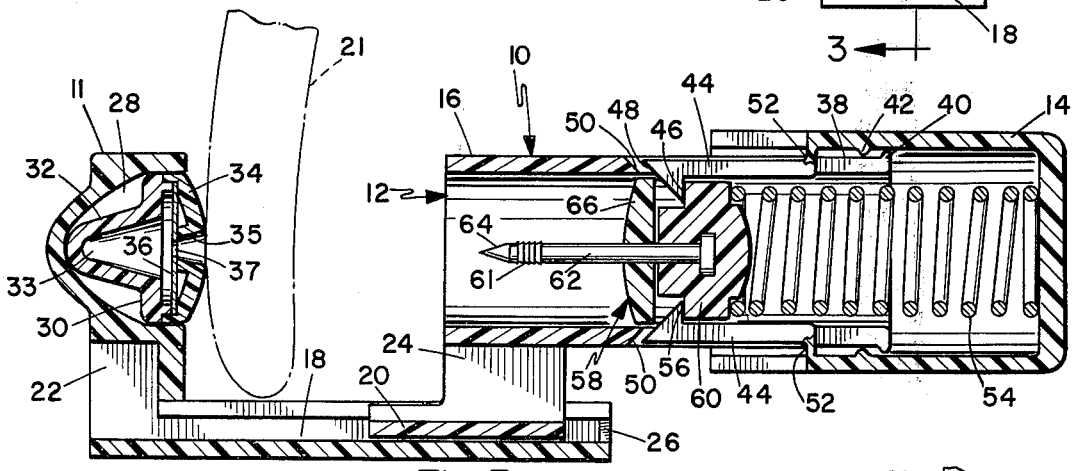
FIG. 3 is a sectional view taken on line 3—3 of FIG. 2.

Referring now to the drawings there is illustrated the disposable earlobe piercing apparatus 10. A carriage 12 is guided by a track 18 for movement relative to an anvil portion 11. The anvil portion is spaced from the track by uprights 22 and the carriage portion supported above and movable along the track by a flange 24. Flange 24 mounts a foot 20 receivable within the rectangular guiding track cross section. End stops 26 on the track prevent the separation of the carriage and anvil. The carriage 12 comprises relatively movable barrel portion 16 and spring housing 14. The spring housing 14 is of sufficient diameter to receive the extension portion 38 of barrel 16. An end stop 40 on the extension 38 engages a corresponding stop 42 on the spring housing 14 to limit the movement of the barrel out of the spring housing 14. A spring 54 bears up against the end wall of the spring housing 14 and against the body portion 60 of dart 58. The dart is retained against the spring pressure by trigger members 44. A flange portion 56 on the trigger member cooperates with the flange portion 46 on the dart body 60 to hold the dart against the compressive stored energy of spring 54. The triggers 44 include ramp portions 48 which cooperate with corresponding ramp portions 50 on the barrel 16. A reduced thickness portion 52 of trigger 44 is utilized to connect the trigger to the spring housing body 14 and therefore bending stress concentrates to cause a permanent deformation of the trigger on actuation of the device. It should be understood that for the purposes of the specification and claims, the term deformation is to include both fracture and plastic deformation wherein the material does not return to its original position after use. The dart 58 includes a shaft 62 with a piercing tip 64. The shaft 62 has a plurality of grooves 61 and mounts a guide button 66 which is a frictional fit within the bore of the barrel 16. The anvil 11 is configured to have a button receiving cavity 28 sized to hold, in a press fit relationship, a catch button 30. The catch button includes a body portion 32 with a dart receiving cavity 33, a catch spring 36 with a dart receiving opening 37, and a cover portion 34 with a dart receiving funnel portion 35.

All of the parts of the device as described may be made from plastic molded material with the exception of the compression spring 54 and catch spring 36 which are made of resilient metallic components and the dart shaft 62 which is a metal compatible with the body tissues.

OPERATION

In use the apparatus according to the invention would be provided in sterilized form and individually packaged and wrapped. The user would remove the apparatus from the package and position the device with the earlobe 21 arranged between the anvil and carriage portions. The end stops 26 on the track permit sufficient movement of the carriage relative to the anvil to receive a wide size range in earlobe thicknesses, but to prevent the insertion of larger body parts. The stops 26 also prevent the dissociation of the anvil from the carriage and the attendant possibility of the dart becoming a projectile.

Figure 4:
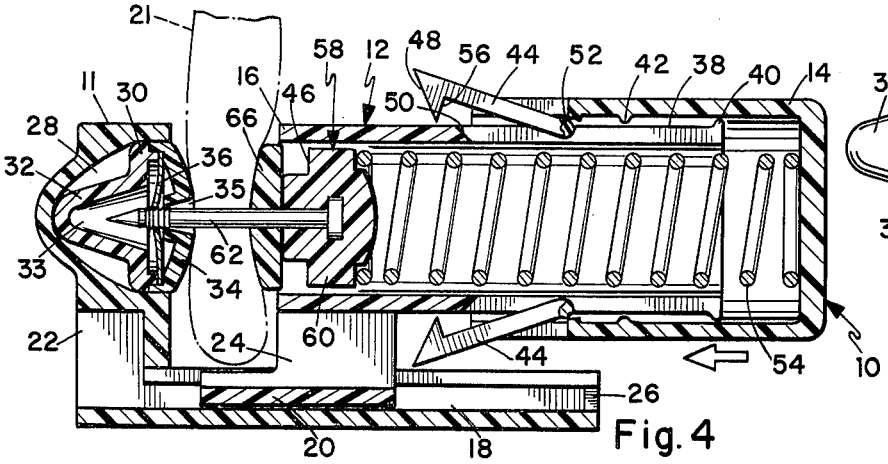
FIG. 4 is a similar sectional view but showing the structure as positioned after actuation.

The user grasps the apparatus, as between the thumb and forefinger, and advances the carriage portion relative to the anvil so that the carriage portion contacts the earlobe. With application of further pressure, the spring 54 is compressed a sufficient additional amount that relative movement between the spring housing 14 and the barrel portion 16 takes place. This causes the ramp portions 48 on the trigger and ramps 50 on the barrel to contact and to cam the triggers radially outwardly from the carriage and therefore to cam the flange portions 56 out of engagement with the corresponding flange 46 on the dart body 60. This releases the dart, as is best illustrated in FIG. 4, causing piercing tip 64 and shaft 62 to penetrate the earlobe. During movement and penetration while the guide button 66 is within the bore of the barrel 16, a guiding action is maintained so that the "aim" of the dart will cause it to accurately enter the openings 35, 37, and 33 in the catch button 30. Any slight misalignment will be corrected by the funnel shaped opening 35 in the cover 34 on catch button 30. The opening 37 in the catch spring 36 is sized to frictionally engage the shaft 62 of dart 58 and therefore the spring 37 is deformed as is illustrated in FIG. 4. In addition to the frictional engagement, latching action is enhanced by the plurality of catch grooves 61 on shaft 62. For maximum catch action these grooves are oriented to present surfaces substantially perpendicular to the distorted opening surfaces on the catch spring 36. Also illustrated in FIG. 4 is the permanent deformation or fracture of the triggers 44. The deformation of the triggers ensures that the individual will not be able to remove the dart and attempt a second piercing operation utilizing the device. This feature then obviates the possibility of infection resulting from the contamination of the dart or other parts of the apparatus.

Figure 5:
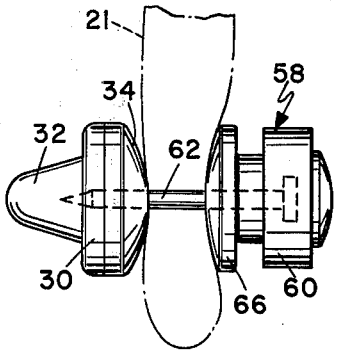
FIG. 5 is a side elevation view of the piercing dart and catch button attached to an earlobe.

As illustrated in FIG. 5, the dart, guide button, and catch button are retained on the earlobe. The resilient nature of the guide button provides a substantially permanent resilient force holding the parts into engagement with the earlobe, and retaining the catch action of the catch spring 36. After the dart shaft has been retained in the pierced earlobe opening for a sufficient period to ensure the healing of the wound and a semi-permanency to the earlobe opening, it is possible to withdraw the dart from the catch button by overpowering the catch spring 36 and withdrawing the dart from the catch button and earlobe opening.

Having described my invention, I now claim.

1. An apparatus for piercing of an earlobe to create and sustain an opening for the attachment of earrings, including a spring propelled piercing dart, and wherein the improvement comprises:

an anvil means, carriage means mounted on said anvil means for guided movement of carriage means toward said anvil means, a piercing dart positioned on said carriage means, spring means retained on said carriage means positioned against said piercing dart and having a resilient bias for driving said piercing dart through an ear lobe and into said anvil means, said piercing dart having a piercing shaft, the axis of said piercing shaft intersecting said anvil means, and latch means including a trigger means responsive to engagement pressure of said carriage means against an ear lobe for releasing said piercing dart from said carriage means.

2. The earlobe piercing apparatus of claim 1 wherein:

said dart has a body portion, said carriage means including a barrel in axial alignment with said dart and interposed between said dart and said anvil means, said dart having a body portion sized to be received through said barrel.

3. The earlobe piercing apparatus of claim 2 wherein:

said shaft of said dart receives a guide button, said guide button has a sliding fit in said barrel.

4. The earlobe piercing apparatus of claim 1 wherein:

said anvil means includes a catch button, said catch button having a bore in alignment with the axis of said piercing shaft, and catch means on said catch button for retaining said piercing shaft.

5. The earlobe piercing apparatus of claim 4 wherein:

said catch means comprises a catch spring with a piercing shaft receiving bore sized to engage and hold said piercing shaft.

6. The earlobe piercing apparatus of claim 5 wherein:

said piercing shaft includes a plurality of grooves disposed to engage said catch spring.

7. The earlobe piercing apparatus of claim 1 wherein:

said trigger means comprises a trigger member mounted for movement with a first part of said carriage means and engaging a ramp on a second part of said carriage means wherein relative movement of said first and said second parts of said carriage means cams said trigger member out of engagement with said dart.

8. The earlobe piercing apparatus of claim 7 wherein:

said trigger member is permanently deformed by movement over said ramp.

9. The earlobe piercing apparatus of claim 1, wherein:

said guide means restrains said carriage means to lineal movement parallel to said axis of said piercing shaft.

* * * * *